United States Patent [19]

Reusswig et al.

[11] 4,080,798

[45] Mar. 28, 1978

[54] ARCTIC DRILLING BASE

[75] Inventors: Gerhard Helmut Reusswig, Conroe; James Dee Bozeman; Don Reagan Ray, both of Houston, all of Tex.

[73] Assignee: The Offshore Company, Houston, Tex.

[21] Appl. No.: 770,239

[22] Filed: Feb. 18, 1977

Related U.S. Application Data

[63] Continuation of Ser. No. 682,066, Apr. 30, 1976, abandoned.

[51] Int. Cl.[2] ..... E02B 17/02; B63B 25/16

[52] U.S. Cl. ..... 61/103; 61/98; 61/101; 62/66; 114/40; 165/134

[58] Field of Search ..... 61/101, 103, 87, 94, 61/98, 88; 62/66, 74; 165/134; 114/40, 264

[56] References Cited

U.S. PATENT DOCUMENTS

| | | | |
|---|---|---|---|
| 3,312,275 | 4/1967 | Daltry et al. | 165/134 X |
| 3,911,687 | 10/1975 | Mo | 61/99 |
| 3,928,982 | 12/1975 | Lacroix | 61/99 X |
| 3,952,527 | 4/1976 | Vinieratos et al. | 61/103 |
| 3,972,199 | 8/1976 | Hudson et al. | 61/103 |

*Primary Examiner*—Jacob Shapiro
*Attorney, Agent, or Firm*—Vinson & Elkins

[57] ABSTRACT

An arctic drilling barge to perform offshore activities in the shallow water, fast ice regions of the arctic seas. Optimal ice interaction is obtained by shaping the hull of the barge in the form of an upright frustum. Ice which does adhere to the barge is detached and melted by circulating fluid through a plurality of interior hull compartments next to the hull sidewalls of the barge.

3 Claims, 15 Drawing Figures

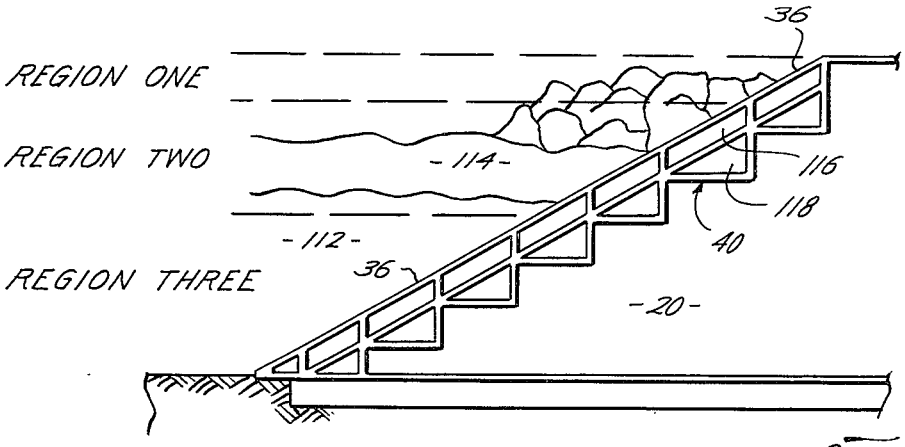
Fig. 11
Fig. 12
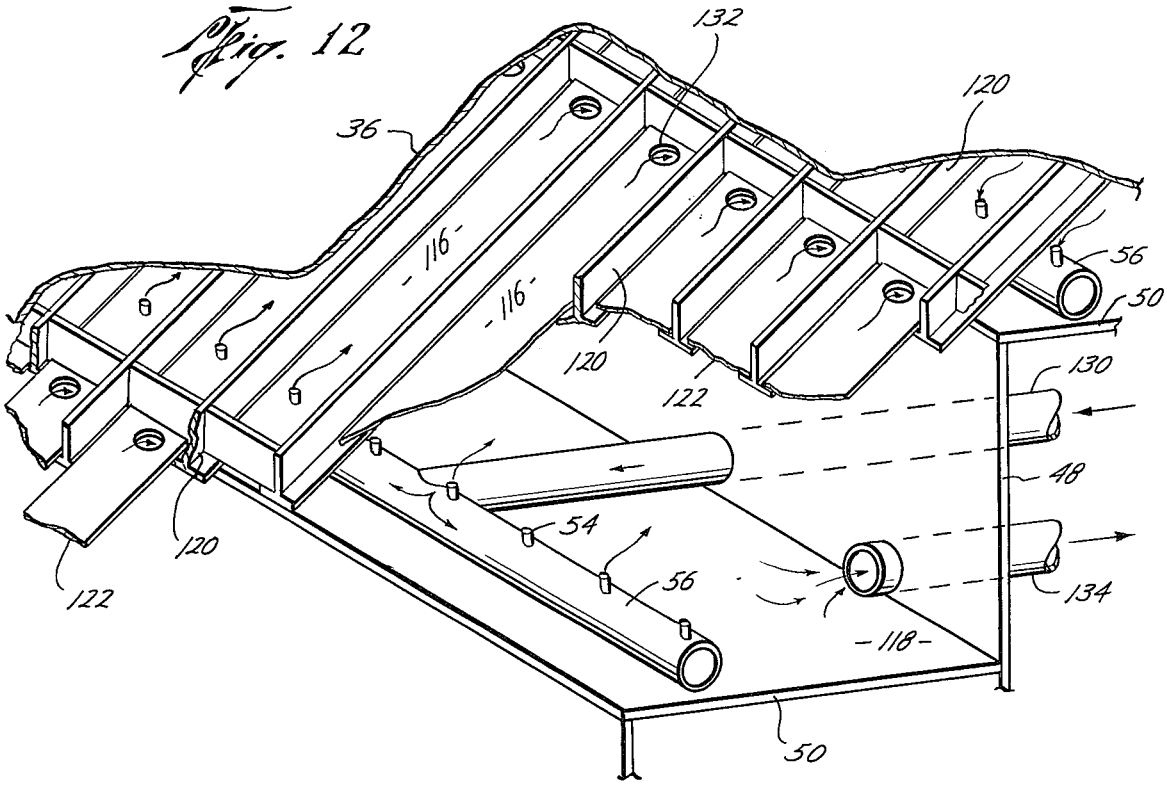

ARCTIC DRILLING BASE

BACKGROUND AND OBJECTS OF THE INVENTION

This application is a continuing application of our prior break margin co-pending Application Serial No. 682,066 filed April 30, 1976 now abandoned.

This invention relates to an artic drilling barge which is floated into position and then partially submerged so that it is placed in contact with the seabed. Once submerged, drilling operations are performed from the barge. The barge is particularly adapted to be used in the shallow water, fast ice regions of the arctic seas.

The use of a submersible drilling island from which drilling operations can be performed has been proposed for the fast ice regions of the arctic seas. Such a drilling island is disclosed in the United States Letters Pat. No. 3,740,956. Problems with drilling islands include their increasing cost as the water depth increases and their poor ice interaction features.

The use of a depending skirt on the bottom of an object placed in contact with the seabed to enhance its holding capability is disclosed in the United States Letters Pat. No. 3,021,680 and 2,938,353. The aforementioned U.S. Pat. No. 3,021,680 patent further discloses the use of a hydraulic system to remove material beneath the object to further enhance its holding capabilities.

It is an object of this invention to provide an arctic drilling barge with an improved ice interaction capability while the barge performs drilling operations.

Another object of this invention is to provide an arctic drilling barge for use in the shallow water, fast ice regions of the arctic seas which interacts with the ice in a manner so that the principal of ice failure is in bending.

Another object of this invention is to provide an arctic drilling barge for use in the fast ice regions of the arctic seas which prevents the adfreezing of the natural ice cover to the barge hull.

Another object of this invention is to provide an arctic drilling barge for the use in the arctic seas which includes a system for insulating the hull sidewalls of the barge, particularly above the level of the natural ice cover.

Another object of this invention is to provide an arctic drilling barge which includes means for circulating liquids through selected interior hull compartments adjacent the hull sidewalls of the barge.

These and other objects and features are advantages of this invention will be apparent from the drawings, the description of the preferred embodiment, and the attached claims.

BRIEF DESCRIPTION OF THE DRAWINGS

In the drawings wherein like numerals indicate like parts and wherein an illustrative embodiment of this invention is shown:

FIG. 11 is a schematic side view of an arctic drilling barge according to this invention showing the surrounding ice levels.

FIG. 12 is an isometric exploded view of a portion of the hull sidewalls of the arctic drilling barge according to this invention showing preferred hull compartments and means for circulating fluids through such hull compartments.

DESCRIPTION OF THE PREFERRED EMBODIMENT

In a search for deposits of oil and gas, man is conducting activities in some of the more forbidding areas of the earth. One of these areas is the arctic seas. The environmental conditions encountered in the arctic seas are extremely severe and impose additional design criteria upon drilling structures used in this area.

During those periods of the year when the arctic seas are covered with ice, a bottom resting barge exposed to the ice field will be acted upon by lateral loading whenever the ice field moves. The magnitude of the lateral loading is a function of ice strength, ice thickness, magnitude of ice movement and the structural shape and area of the ice/barge interface.

The arctic drilling barge of this invention is intended to operate in the shallow water, fast ice regions of the arctic seas, that is, in areas where the water depth ranges from five to sixty feet and the ice is either shore bound or bottom bound and does not normally exceed seven feet in thickness. In order to safely operate in this region a drilling vessel should be capable of remaining in its operating position and resisting movement due to lateral ice loading. The arctic drilling barge according to this invention is capable of remaining in its operating position and resisting movements from lateral ice loading through means arising from and reinforced by its design.

Figure 1:
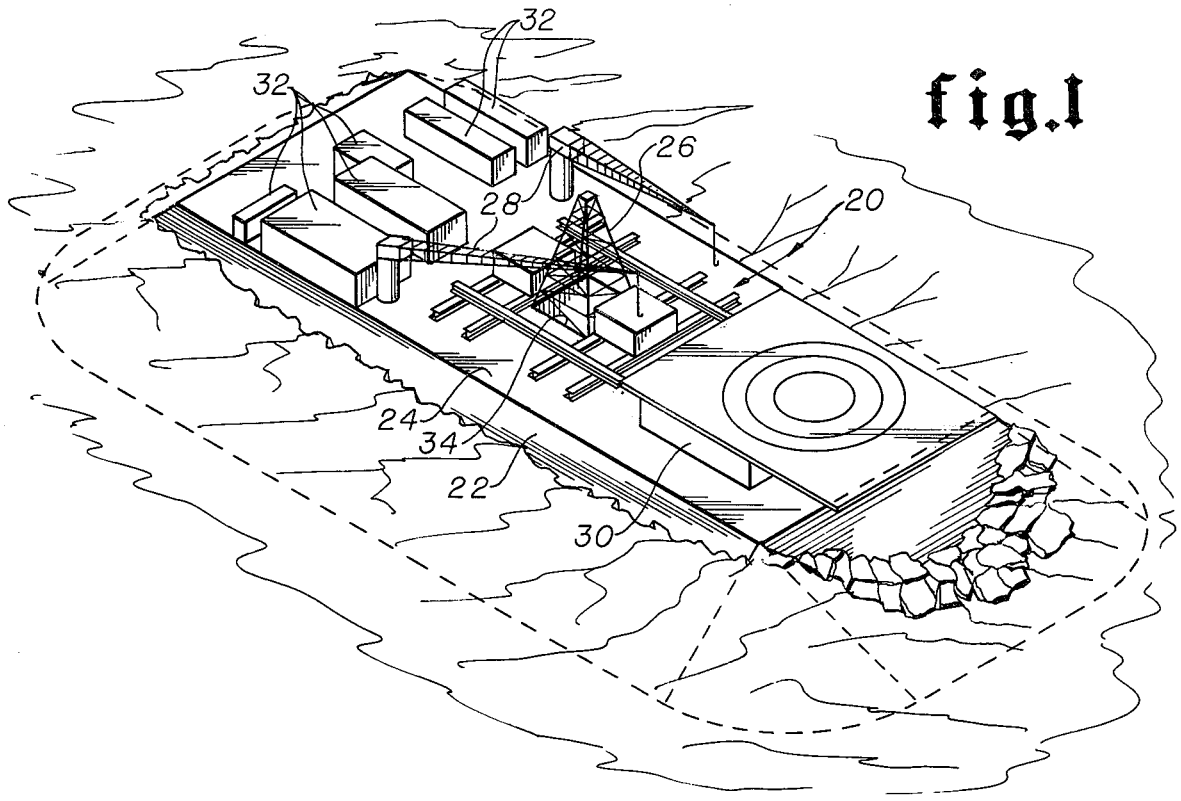
FIG. 1 is a perspective overall view of an arctic drilling barge according to this invention performing drilling operations in the fast ice region of the arctic seas.
Figure 2:
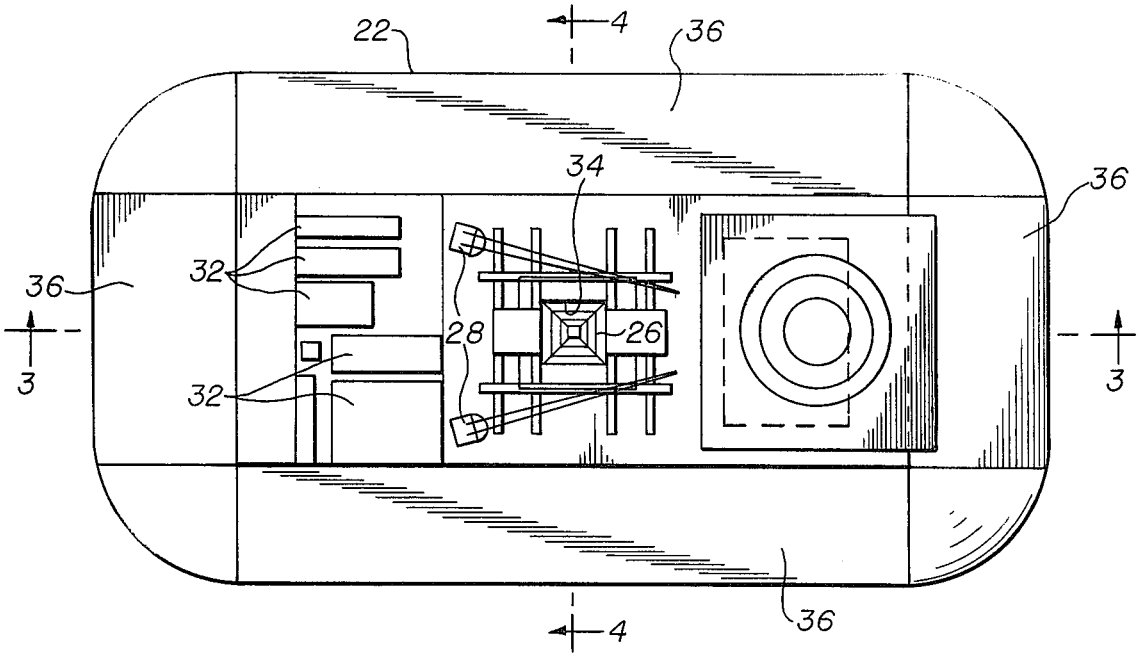
FIG. 2 is a top view of an arctic drilling barge according to this invention.

The arctic drilling barge of this invention has an improved holding capability with the seabed and has an improved ice interaction capability to reduce the lateral loads upon the vessel. The overall configuration of the drilling barge 20 is illustrated in FIG. 1 and a top view is shown in FIG. 2. The drilling barge 20 includes a hull 22 and a deck 24. Upon the deck 24 drilling equipment and various buildings are positioned. The equipment may comprise a drilling rig 26 and cranes 28 and the buildings may include a structure 30 for crew quarters and storage facilities 32.

The drilling barge 20 is floated into position in the arctic seas, partially submerged until the hull bottom engages the seabed, and drilling operations are thereafter conducted from the deck 24 through aperture or moonpool 34. To float the barge 20 and partially submerged it, the hull 22 is ballastible and deballastible and the barge 20 includes ballast chambers and pumps within the hull 22 to pump water into and out of the ballast chambers.

Ice bearing laterally against the hull sidewalls 36 imposes a lateral load upon the barge 20 tending to move the bottom of the hull across the seabed. The drilling barge 20 according to this invention is configured to reduce such lateral loading while increasing the tendency of the ice to break up around the barge 20 and also increasing the vertical forces imposed upon the barge 20 to improve its bottom-holding capabilities. To accomplish this, the hull 22 of the drilling barge 20 is shaped in the form of an upright frustum. The sidewalls 36 of the hull preferably incline upwardly and inwardly toward the deck 24 at an angle of 25° to 45° with respect to the waterline, as illustrated by the angle $\phi$ in FIGS. 3 and 4. The corners of the hull preferably are conically shaped with the apex of the cone positioned adjacent the deck 24 whereby the angle of inclination of the sidewalls even at the corners is 25° to 45° with respect to the waterline. With such a shape, ice which has not adhered to the hull sidewalls tends to slide upward along the hull sidewalls 36 creating tensile stresses within the ice at its bottom surface. These tensile stresses are formed where the ice is weakest and cause it to fail in bending. The ice failures induced by bending stresses provide a marked advantage over conventional drilling barges wherein the predominent ice failure mode is not in bending and a solid sheet of ice often surrounds the drilling barge and exerts very high lateral loads upon the hull sidewalls. An additional benefit from the inclination of the sidewalls produces a component of the lateral ice loading which contributes to an increase in the vertical loading upon the barge 20. In some types of soil this increased vertical loading will increase the lateral holding capability of the soil beneath the bottom of the barge.

The arctic drilling barge 20 according to this invention includes means for maintaining the natural ice cover detached from the hull sidewalls and for melting the ice rubble which may encroach upon the hull sidewalls above the level of the natural ice cover. The detaching and melting means also prevents local thickening of the natural ice cover in the vicinity of the sidewalls 36. As is illustrated in FIGS. 3, 4, 5 and 11, such means for detaching and melting the ice cover includes a plurality of hull compartments 40 within the hull 22 adjacent the internal surface of the hull sidewalls 36, interior compartments 42 within the hull 22, communicating means between each of the plurality of hull compartments 40 and the interior compartment 42 for circulating fluid therebetween, circulating pump means 44 for pumping fluid between the interior compartment and the plurality of hull compartments through the communicating means, and heat source means for heating the circulating fluid prior to the time it is pumped into the plurality of the hull compartments.

Figure 3:
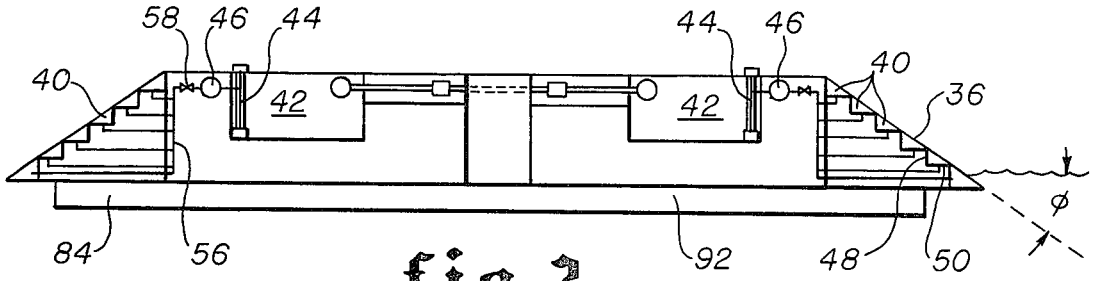
FIG. 3 is a view in cross-section of the hull of the arctic drilling barge illustrated in FIG. 2 taken along line 3—3 in FIG. 2.
Figure 4:
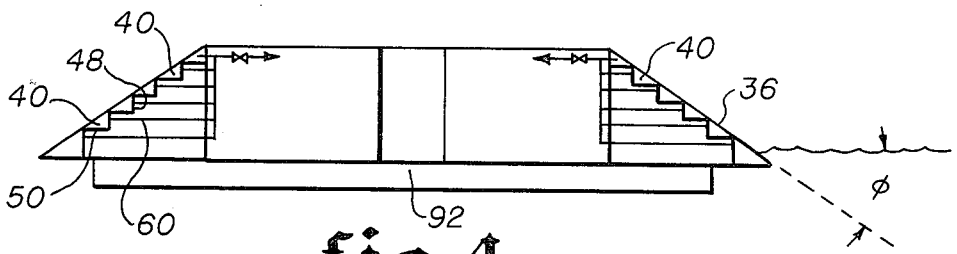
FIG. 4 is another view in cross-section of the hull of the arctic drilling barge illustrated in FIG. 2 taken along line 4—4 in FIG. 2.
Figure 5:
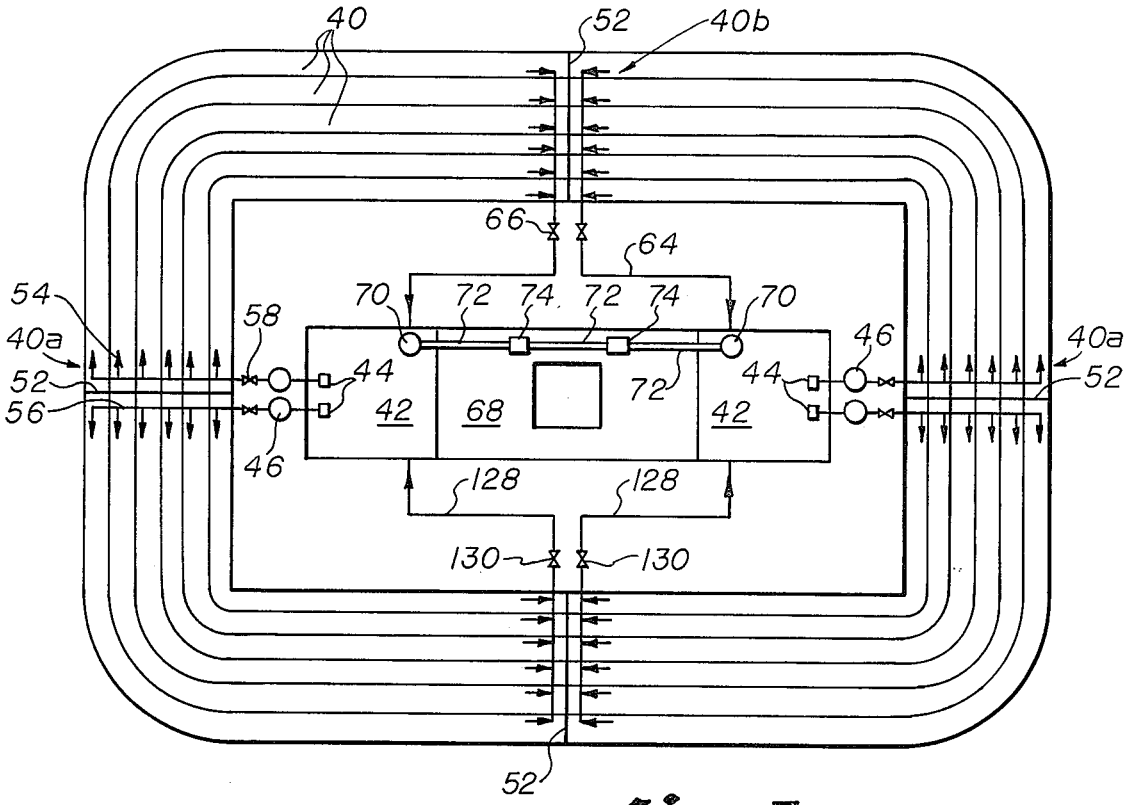
FIG. 5 is a top schematic view of the circulation system for the arctic drilling barge illustrated in FIG. 2.

A form of the hull compartments 40 which was originally believed to be advantageous is shown in cross-section in FIGS. 3 and 4 and is shown schematically in FIG. 5. The hull compartments 40 permit circulation of fluid against the inner surface of the hull sidewalls 34. Each of the hull compartments illustrated in FIGS. 3, 4 and 5 is triangular in cross-section with one wall being formed by the internal wall of the hull sidewalls 36, a second wall formed by a vertical bulk head 48 within the hull 22 and a third wall formed by a horizontal bulk head 50. Each such hull compartments 40 is horizontal and extends longitudinally around the entire internal surface of the sidewalls 36 of the hull. To define the ends of the various hull compartments, a plurality of water-tight bulkheads 52 are positioned within the hull 22. As many water-tight bulkheads 52 as desired may be utilized. The distance of the hull compartments between bulkheads preferably is such that fluid may be circulated therethrough without freezing. Thus the distance of the various hull compartments 40 between bulkheads will be determined by many factors, including the temperature to which the fluid is heated before it is pumped into the hull compartments, the rate the fluid is pumped through the hull compartments and the temperature of the water and ice surrounding the hull 22. Of course, the increased number of conduits necessary for the communicating means, when more hull compartments are used, is another design factor to be considered. In FIG. 5, four water tight bulkheads 52 are illustrated, and each of the illustrated hull compartments 40 extends around one-fourth of the internal surface of the hull sidewalls 36.

The circulating fluid preferably is stored within internal compartments within the hull 22. In FIGS. 3, 4 and 5, the hull 22 is shown including two such interior compartments 42. The hull 22 may be designed with any desired number of interior compartments of any desired size and configuration. Design factors include the volume of fluid to be circulated, the heating requirements for this fluid, the circuitry for the conduits communicating between the hull compartments and the interior compartments, and the stability of the drilling barge 20 while it is floating.

Figure 6:
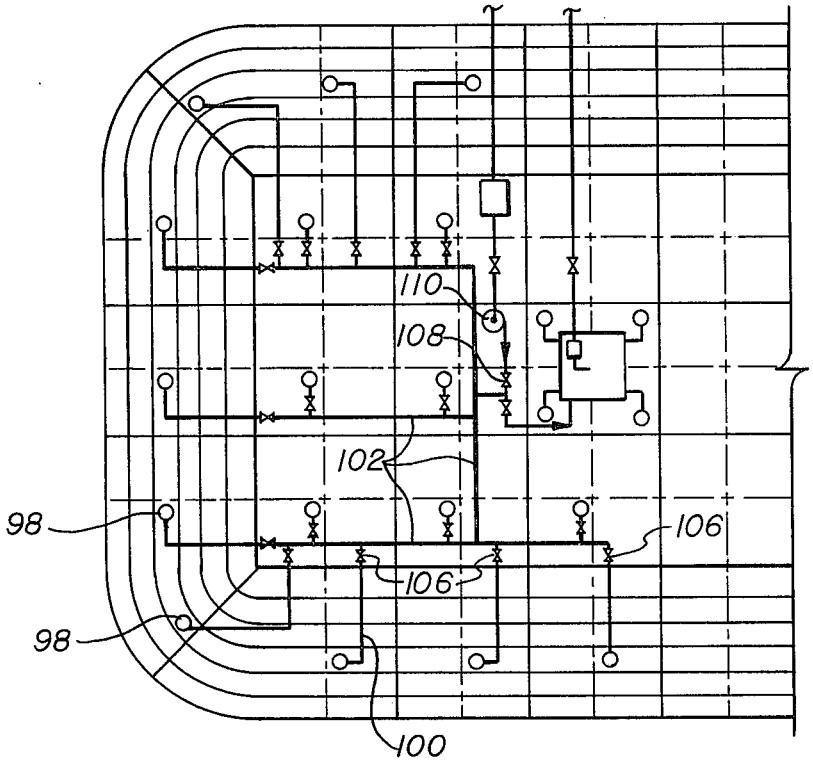
FIG. 6 is a partial schematic plan view showing a hydraulic system for the arctic drilling barge illustrated in FIG. 2.

The communicating means establishes circulation of fluid between the hull compartments 40 and the interior compartments 42. As illustrated in FIGS. 3 and 5, fluid is supplied to each of the hull compartments 40 at one end **40*a* thereof, by a plurality of supply conduits 54, each of which extends to a different one of the hull compartments from a supply manifold 56. A valve 58 controls flow of the fluid from the pump 44 to the supply manifold 56. As seen in FIGS. 4 and 6, fluid is discharged at the other end 40*b* of the compartments 40 through discharge conduits 60. Each discharge conduit 60 extends from a different one of the hull compartments 40 to a return manifold 62. From the return manifold 62, the fluid is conducted to the internal compartments 42 through a return conduit 64 which is controlled by valve 66**.

The circulating fluid in interior compartment 42 preferably is heated by a heat source means prior to the time it enters the hull compartments 40. The preferred source of heat is waste heat from the prime movers. FIG. 5 illustrates two different systems for utilizing the prime mover waste heat to heat the fluid. In the first system, a prime mover waste heat exchanger 46 is employed. The circulating fluid passes through such prime mover heat exchanger while being pumped from the interior compartment 42 to the hull compartments 40 as illustrated schematically in FIGS. 3 and 6. The second system for heating the circulating fluid preferably comprises a heat exchanger system for exchanging heat from a heat source, such as, the engine room 68, to a working fluid which transmits the heat to the circulating fluid within the interior compartments 42. Preferably the heat exchange system includes a heat sink 70 in each interior compartments 42 for exchanging heat from working fluid to the circulating fluid within the interior compartment and includes means, such as tubing 72, for circulating the working fluid between the heat sink 70 in the interior equipment 42 and a heat sink 74 in the heat source. Should the prime mover waste heat be insufficient to meet the hull heating demand, one or more boiler-type heaters may be brought into service as primary or supplemental heat sources.

Figure 8:
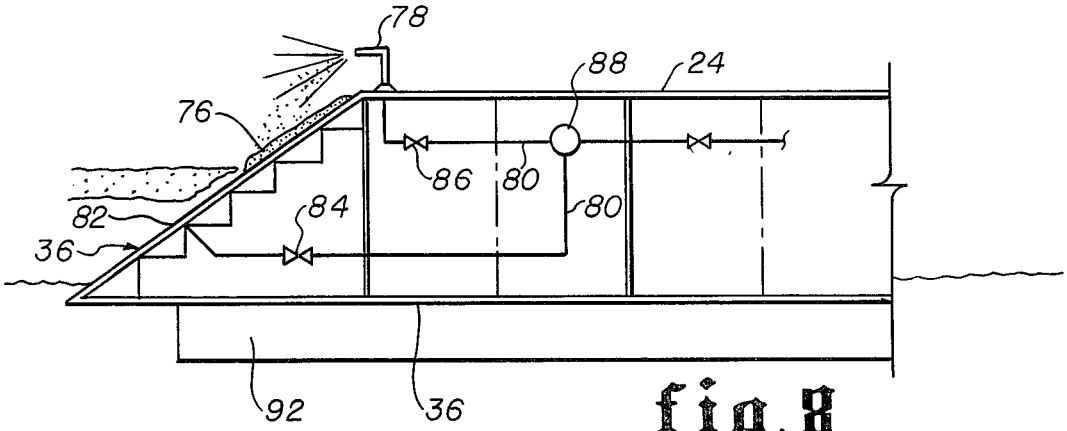
FIG. 8 is a schematic side view showing a possible insulating system for the arctic drilling barge illustrated in FIG. 2.

When the surrounding ambient air temperature is below freezing (below 28° F or −2° C for sea water), a very large heat loss can occur from these hull compartments 40 near the deck 24 where the sidewalls 36 are exposed to the surrounding air. Such heat loss can result in the freezing of the circulating fluid within these upper hull compartments 40. The arctic drilling barge according to this intention preferably includes an insulating system to reduce such a heat loss. An insulating system of the type originally thought to be advantageous is illustrated in FIG. 6. The insulating system forms a thin insulating layer 76 of ice on the external wall of the hull sidewalls 36 above the waterline where the sidewalls 36 are exposed to the surrounding air. The insulating system includes spraying means for spraying water onto the sidewalls 36 of the hull 22. The water, upon being exposed to the low temperature of the surrounding air, will freeze upon the sidewalls 36 on that portion of the sidewalls 36 above the waterline. The spraying means includes a plurality of nozzles 78 extending around the deck 24 and directed to spray water upon the hull sidewalls 36. It also includes conduit means 80 extending between a source of water and the plurality of nozzles 78. The source of water utilized could be either the water surrounding the barge and beneath the natural ice cover 85 or ballast water from inside the hull 22. In FIG. 8, the source of water utilized is the water surrounding in the barge 20, and the conduit means 80 extends from a port 82 through the hull sidewall 36 near the bottom of the sidewall. Valves 84 may be positioned within the conduit means 86 to control flow from the ports 82, while additional valves 86 may be positioned within the conduit means 80 to control flow to each nozzle 78. The spraying system also includes pumps 88 for pumping water through the conduit means 80.

Another type of insulation system may be provided by permitting the formation of a thin layer of ice within the hull compartments 40 on the interior wall of the hull sidewalls 36. This layer of ice insulates the hull sidewalls and reduces the heat loss from the hull compartments 42. It was originally recognized that permitting the formation of a thin layer of ice within the hull compartments 42 has the possible disadvantages that the ice could impede fluid flow through the communicating system and could solidify the circulating fluid, thereby freezing the entire compartment. Such disadvantages could cause a blockage of the flow of fluid to the hull compartments 40 with a consequential loss of the beneficial effects provided by such circulation. It is now believed these possible disadvantages can be overcome with the arctic drilling barge according to this invention which allows close temperature and flow control of fluid through the hull compartments whereby a relatively thin layer of ice may be allowed to form inside the hull compartment without the entire compartment freezing.

FIGS. 11 through 15 illustrate the preferred method and apparatus according to this invention for circulating fluids through the interior hull compartments adjacent the external wall of the hull sidewalls to selectively insulate the hull of the barge and reduce the heat loss from the barge and to selectively detach and melt the natural ice cover which encroaches upon the hull sidewalls. Referring to FIG. 11, which illustrates in cross-section a portion of the hull of the barge, the barge 20 is shown resting on the seabed. The sea 112 is in contact with the hull 36 of the barge throughout the area denominated as region three. Encroaching ice 114 is potentially in contact with the hull 36 of the barge in the area denominated as region two. The atmosphere is in contact with the portion of the hull 36 of the barge denominated as region one. Depending upon the water depth and the ice depth, the dimensions of the three regions vary substantially. Since the seawater in contact with the hull 36 in region three is ice-free and above freezing temperature, there is no danger of adfreezing or loss of circulation, and relatively little heat is lost from the barge through the hull 36 in region three. The ice imposed adjacent to the hull 36 in region two also acts as a relatively good insulator and will prevent the loss of relatively large magnitudes of heat in such region. On the other hand, unless some means is utilized to insulate the hull 36 in region one, substantial heat will be lost to the atmosphere from the barge 20 in region one. Thus, it is preferably in the arctic drilling barge according to this invention that a method and apparatus be employed for selectively insulating the hull 36 of the barge at preselected portions and selectively supplying heat to the hull 36 of the barge at preselected portions to prevent the encroaching ice from adfreezing to the hull.

The equation for approximating the rate of heat-transfer from a circulating fluid to the inner surface of the hull sidewalls 36 per unit area of sidewall is stated in the following equation wherein Q is the heat transfer rate, H is the convective heat transfer coefficient, A is the area of the hull sidewall being considered, and ΔT is the temperature difference between the wall and the fluid;

$$Q/A = H \cdot (\Delta T)$$

The temperature difference $\Delta T$ is a gross quantity since it is the difference between the effective fluid temperature and the effective wall temperature where these quantities vary in the plane of the wall and the distance from the wall. The heat transfer coefficient H is also a gross quantity which represents the overall effect of using a particular fluid, the shape and orientation of the fluid/wall interface, and the motion of the fluid and the like. For a given heat transfer rate and sidewall temperature, the larger the value of the heat transfer coefficient H, the lower the temperature difference $\Delta T$ may be. In order to conserve heat resources and maintain pumping rates at an efficient level, the temperature of the fluid in the circulating fluid system should be kept preferably at a low level and the heat transfer coefficient be maintained at a large magnitude.

Figure 13:
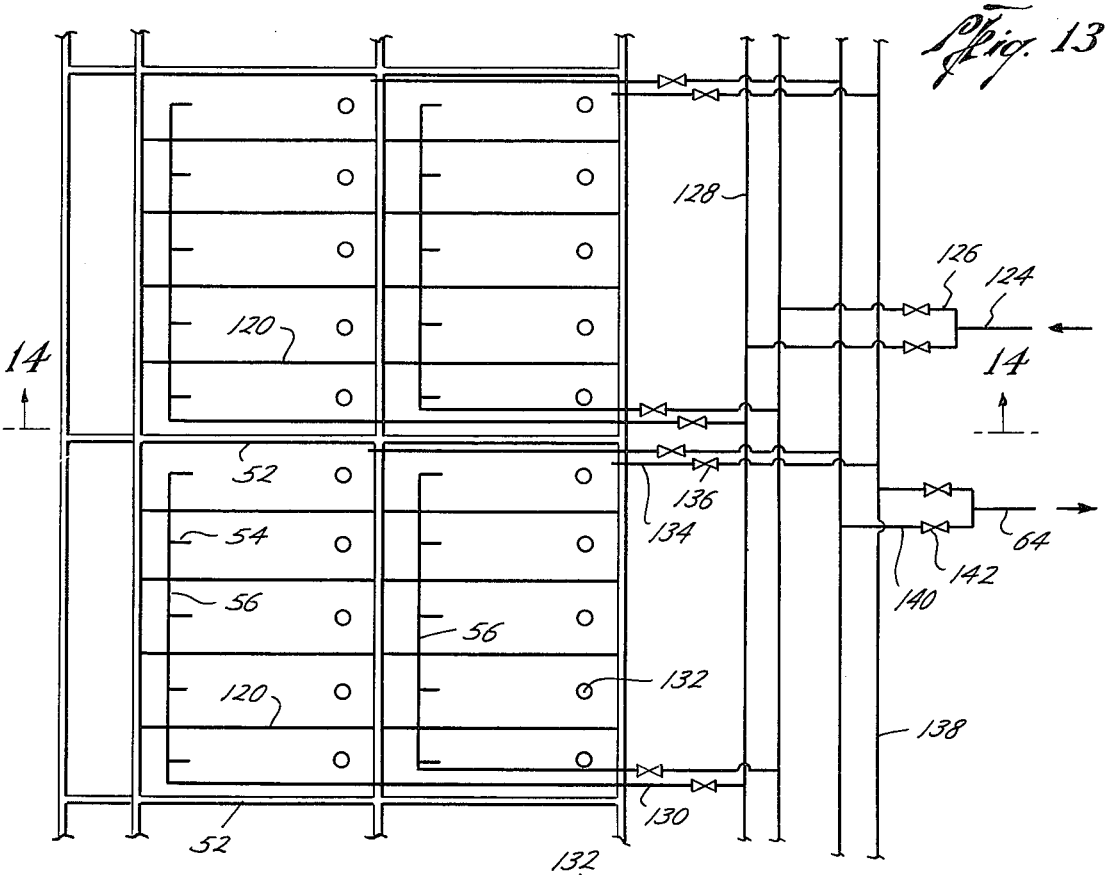
FIG. 13 is a plan view of a portion of the hull compartments of the arctic drilling barge according to this invention shown in FIG. 12 showing the hull compartments in section and showing the hydraulic system for circulating fluid through the hull compartments.
Figure 14:
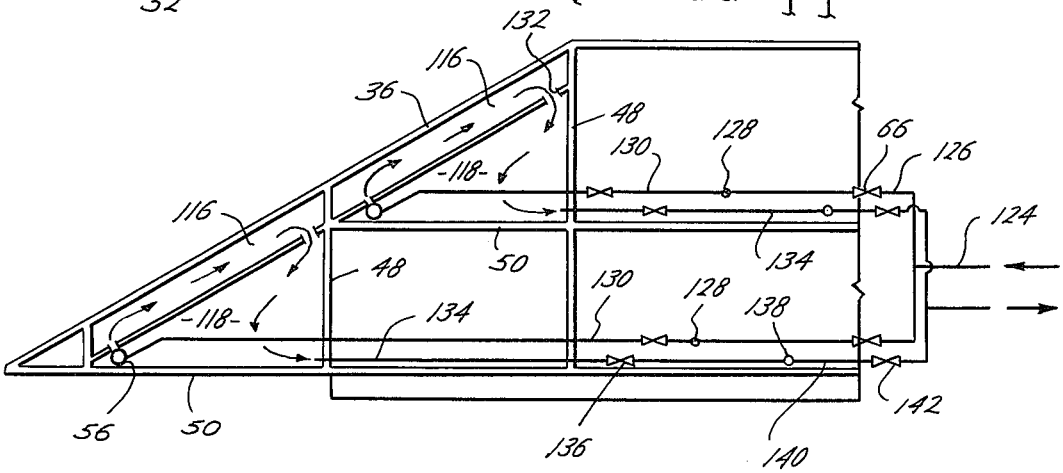
FIG. 14 is a side view of a portion of the hull compartments shown in FIG. 12 of the arctic drilling barge according to this invention showing the hull compartments in section and showing the hydraulic system for circulating fluids through the hull compartments.

The preferred method and apparatus for selectively distributing heated circulating fluid to the hull sidewalls is illustrated in FIGS. 11, 12, 13 and 14. The preferred hull compartment 40 comprises a forced convection channel 116 and a heat sink chamber 118. The forced convection channels 116 preferably are formed within the space between the hull sidewall 36 and sidewall stiffeners 120, which stiffeners preferably are secured in parallel relationship between a plurality of water-tight bulkheads 52. The stiffeners usually are already present for construction strength and the preferred artic drilling barge according to this invention takes advantage of their presence. The interior portion of the forced convection channel 116 is formed by metallic panels 122 secured to the sidewall stiffeners 120. The resulting forced convection channels 116 are generally parallel and approximately rectangular in cross-sections. They can be utilized as a single flow channel or subdivided longitudinally into two or more systematically parallel flow channels. The number of forced convection channels 116 will depend upon the depth of the barge hull, the length of the sidewall, and the degree of temperature control desired. Each forced convection channel preferably is vertically oriented in that it extends upwardly along the inside of hull sidewalls, as distinguished from being horizontally oriented as are the hull compartments illustrated in FIG. 5. Each of the forced convection channels preferably is inclined from the vertical to create flow patterns which allow ice to form on the inside of the hull sidewalls. Since the hull of the barge preferably is shaped in the form of an upright frustum with the sidewalls of the hull having an angle of inclination with respect to the water line from between 25° to 45°, positioning the forced convection channels whereby they parallel the angle of inclination of the hull sidewalls provides the preferred inclination of the forced convection channels. Associated with a selected number of each of the forced convection channels is a heat sink chamber 118. Each of the heat sink chambers 118 shown in FIGS. 12, 13 and 14 is trianbular in cross-section and is formed between the internal side of the panels 122, a vertical wall formed by a vertical bulkhead 48 within the hull 22 and a horizontal wall formed by the horizontal bulkhead 50. The ends of the heat sink chambers 118 preferably are formed by vertical bulkheads 52.

In the preferred embodiment illustrated in FIGS. 12, 13 and 14, the sidewall forced convection channels 116 extend upwardly along the inner surface of the hull sidewalls 36. Heated fluid is introduced at one end of each forced convection channel 116, preferably the lower end, and then the heated fluid flows along the channel while heat is transferred to the inner surface of the hull sidewall 36. At the downstream end of the forced convection channel 116, preferably the upper end of such channel, the circulating fluid flows out and into the heat sink chamber 118 which is located behind the forced convection channel 116. The heat sink chambers 118 provide thermal inertia as they store fluid having a temperature higher than that of the surrounding environment and prevent the rapid freezing of the fluid moving through the forced convection channels. The heat sink chambers also may function as additional ballasting means.

The flow of the heat fluid can be traced in FIGS. 13 and 14. The heated circulating fluid is pumped from the interior chambers 42 through supply conduit 124 into branch supply lines 126. The heated circulating fluid flows through circuitry control valves 66 installed in the branch supply lines 126 and which function to control the flow to each hull compartment level. Each branch supply line 126 connects to a supply manifold line 128 on that hull compartment level. From each supply manifold line 128, individual conduits 130, with control valves 58 installed therein, extend to the distribution manifolds 56 located in each hull compartment 40 on that level. From the distribution manifold 56 extend a plurality of distribution conduits 54 from which the heated fluid flows into the forced convection channels. The fluid enters the forced convection channels 116 at the lower ends thereof, flows through the channels and exits through an opening 132 formed in each channel and flows into the heat sink chambers 118. The collected flow in each heat sink chamber 118 returns to the interior compartments 42 through circuitry communicating therebetween. The return flow circuitry comprises conduits 134 extending from each of the heat sink chambers 118 through control valves 136 to separate collection manifolds 138. The collection manifolds 138 communicate with the return flow conduit 64 through connecting conduits 140 having control valves 142 therein.

Figure 15:
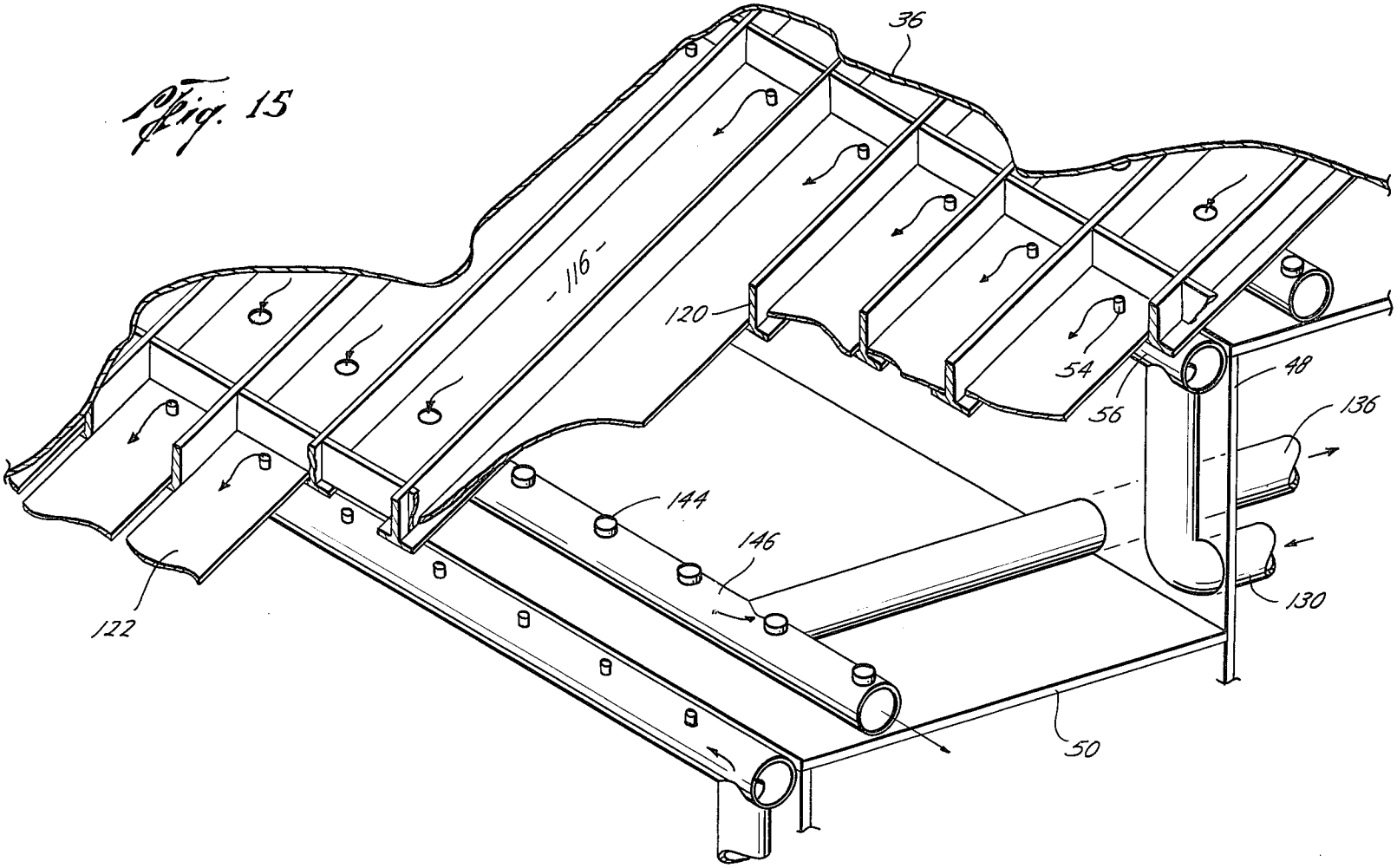
FIG. 15 is an isometric exploded view of a portion of the hull sidewalls of an arctic drilling barge according to this invention showing preferred hull compartments and an alternate means for circulating fluid through such hull compartments.

An alternate arrangement for the forced circulation of heating fluid through the forced convection channels 116 is illustrated in FIG. 15. In this method and apparatus, the construction of the forced convection channels 116 is unchanged from the preferred embodiment described in FIGS. 12, 13 and 14 except, as illustrated in FIG. 15, the individual conduits 130 transporting the heated fluid into the hull compartments 40 deliver the fluid to distribution manifolds 56 located at the upper end of each of the forced convection channels 116. Accordingly, the heated fluid is supplied into the forced convection channels 116 through a plurality of distribution conduits 54 and the heated fluid flows downwardly to the lower end of such channels 116. At the lower downstream end of the forced convection channels 116, the heated fluid flows outwardly through collection conduits 144 and into a collection manifold 146 which communicates through conduit 136 with the interior compartments 42 as described in the previous figures. Preferably all of the valving and circuitry associated with this hydraulic system is the same as shown in the preferred arrangement described with respect to FIGS. 12, 13 and 14. The major difference between the system as described with respect to FIG. 15 and the system described with respect to FIGS. 12, 13 and 14 is that in the FIG. 15 system the hull compartments 40 do not include heat sink chambers 118 and therefor the location of the water tight bulkheads 52 along the barge sidewalls is no longer dictated by hull heating requirements. However, this increased flexibility in structural arrangements generally is offset by increased piping costs and the loss of thermal inertia in the flow system near the sidewalls.

Figure 9:
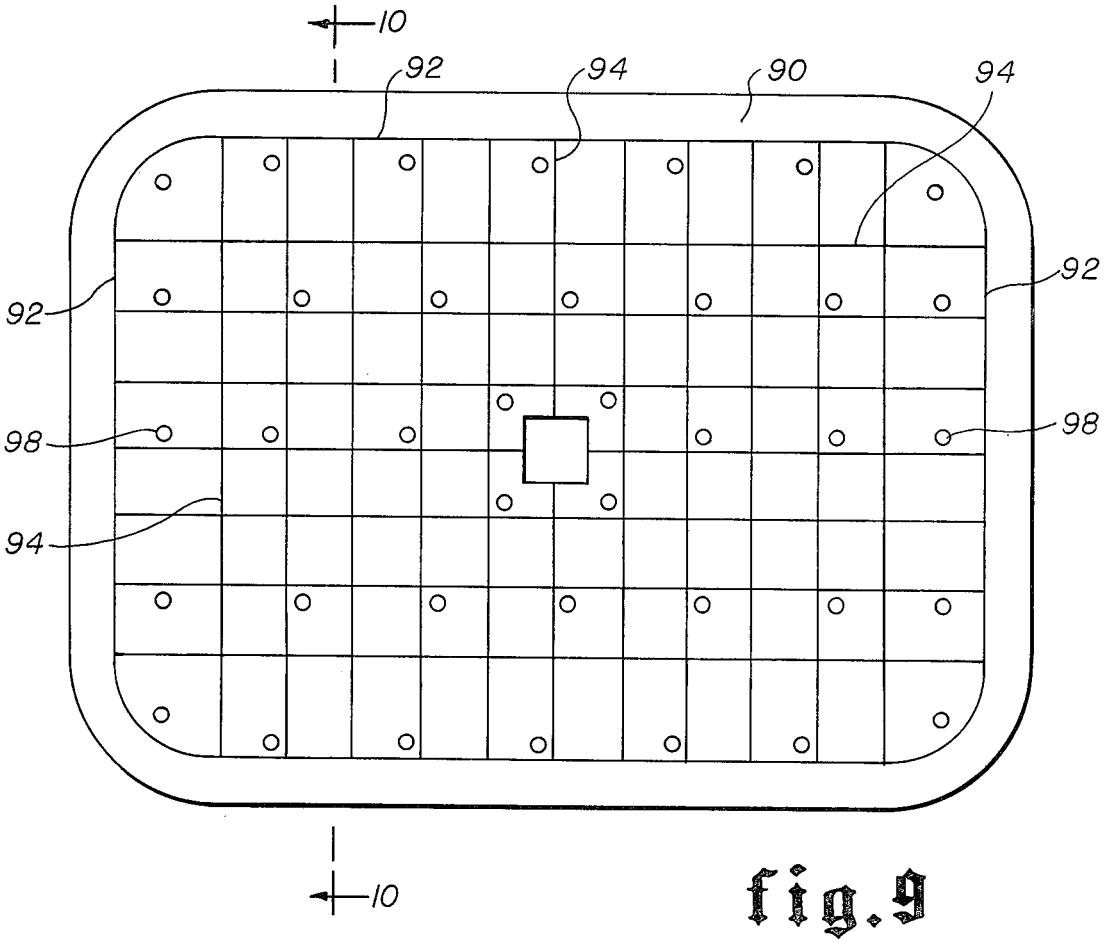
FIG. 9 is a bottom view of the arctic drilling barge illustrated in FIG. 2.
Figure 10:
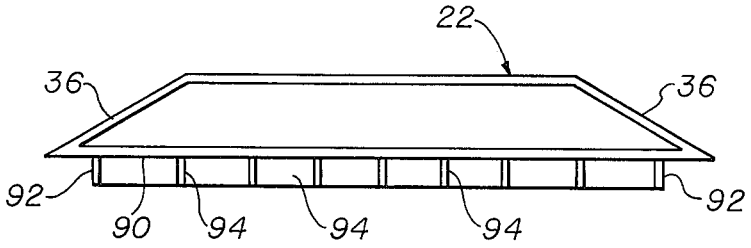
FIG. 10 is a view in cross-section of the bottom of the hull taken along line 10—10 in FIG. 9.

When it is desired to perform drilling operations from the arctic drilling barge 20, the barge is submerged until its bottom rests upon the seabed floor as illustrated in FIG. 8. The soil conditions believed to exist on the seabed floor in the fast ice regions of the arctic seas are fine silts and clays and possibly some find sands. Such soil conditions do not provide a great deal of lateral support. Therefore, the bottom of the arctic drilling barge 20 preferably is designed to obtain maximum interaction with the seabed floor and thereby maintain the arctic drilling barge 20 in a stationary position notwithstanding the interaction of ice forces upon the arctic drilling barge 20. The preferred barge includes downwardly projecting skirt means mounted on the bottom 90 of the hull. When the drilling barge 20 is submerged, the skirt means projects into the seabed floor and increases the holding capabilities of the hull bottom. As seen in FIGS. 9 and 10, the skirt means preferably includes a downwardly extending member 92 which is positioned around the bottom of the hull adjacent the circumference thereof and a plurality of interconnecting downwardly extending members 94 positioned at selected intervals along and across the bottom of the hull, thereby forming a grid network on the hull bottom 90.

The ice forces acting upon a drilling barge in a particular direction are generally proportional to the characteristic width of the drilling barge in the ice contact zone, that is, the cross-sectional length of the drilling barge between its widest points perpendicular to the direction of the force of the ice. The holding forces exerted upon the drilling barge bottom by the seabed floor are generally proportional to the square of the characteristic width of the bottom of the hull. To obtain a holding force sufficient to overcome the ice force, it has been found that minimum characteristic width for the barge bottom is 96 feet.

Figure 7:
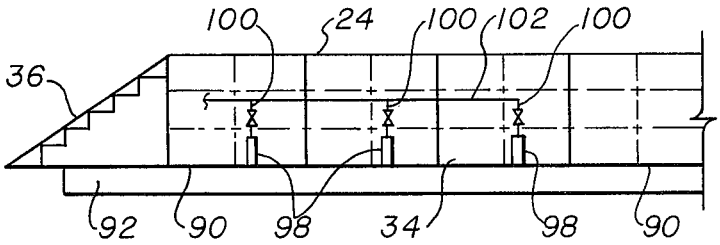
FIG. 7 is a partial schematic side view showing the hydraulic system for the arctic drilling barge illustrated in FIG. 2.

The interaction between the barge bottom and the seabed floor is also increased by the use of a hydraulic system which can pump material from beneath the bottom of the hull and thereby create a vacuum effect between the hull and the seabed floor. Such a hydraulic system is illustrated in FIGS. 6, 7 and 8. The hydraulic system includes a plurality of standpipes 98 opening through the hull bottom 90. Preferably each of the grids in the network formed by the interconnecting members 92 and 94 of the skirt means, includes a standpipe 98. Tubing 100 extends from each one of the standpipes 98 to a manifold 102. Communicating with the manifold 102 are conduits 104 which extend to the body of water surrounding the drilling barge 20. Valves 106 may be positioned within the tubing 100 to control flow from the manifold 102 to each standpipe 98. Likewise valves 108 may be positioned in the conduit 104 to control flow through the manifolds 102. Reversible pump means 110 are positioned within the conduits 104 and withdraw material from beneath the hull bottom 90 through the standpipes 98 and through the communicating means until it is discharged into the surrounding water. Valves 107 and 108 may be positioned such that flow through conduit 104 can be directed to or from moonpool 34. Those grid spaces beneath the hull and adjacent to the moonpool 34 may be serviced by standpipes 123 which communicate directly with the moonpool through tubing 124.

If the pump means 110 are reverse acting, the hydraulic system can be used to disengage the hull bottom 90 from the seabed floor when the drilling barge 20 is moved to a new location. For such a use, the direction of pumping is reversed and the pump means 110 pump fluid from the surrounding body of water and inject it out of the standpipes 98 to break the contact between the hull bottom 90 and the seabed floor. Once such contact is broken and the hull has been deballasted, the drilling barge 20 can be floated to a new location.

In operation, the drilling barge 20 of this invention is utilized to provide a mobile platform from which drilling operations may be performed in the shallow water, fast ice region of the artic seas. The drilling barge 20 is floated to a location where the drilling operations will be performed, either under its own power or towed under the power of another vessel. Once the drilling barge 20 has reached the drilling location, it is ballasted until the hull bottom 90 engages the seabed floor. The skirt means projects into the seabed floor and increases the holding power of the hull bottom. To further increase the holding power of the hull bottom, material beneath the hull bottom and within the various grids of the skirt means is pumped through the hydraulic system into the surrounding body of water to create a vacuum effect between the hull bottom and the seabed floor.

Drilling operations are performed through the moon pool opening extending through the drilling barge hull from the deck to the hull bottom. During drilling operations, ice will encroach upon the hull sidewalls 36. The encroaching ice will slide up the inclined sidewalls 36 and will fail due to bending stresses placed upon the ice. This sliding and breakage of the ice will lessen the lateral forces imposed upon the drilling barge 20, thereby enabling the drilling barge 20 to remain in a fixed location.

The ice is melted and detached from the hull sidewalls 36 through actuation of the circulating system which circulates fluids from the internal compartments 42 through the hull compartments 40 and back into the interior compartments 42. The circulating fluid is heated by passage through the prime mover waste heat exchanger 46 or a boiler-type heat exchanger as it is pumped from the interior compartment 42 to the hull compartments 40 or it is heated when it is within the interior compartment 42. The circulating fluid is heated by passage through the prime mover waste heat exchanger 46 or a boiler type heat exchanger as it is pumped from the interior compartment 42 to the hull compartments 40 or it is heated when it is within the interior compartment 42 and then pumped to the hull compartments.

Preferably, the appropriate valving is operated whereby no heated fluid is circulated through the interior compartments located in region three of the hull. With respect to those hull compartments 40 in region two of the hull 36, sufficient quantities of the heating fluid are circulated through the forced convection channels 116 at a selected temperature whereby the channels 116 preferably do not freeze at all. Thereafter, when it is desired to increase the heat against the hull 36 of the barge whereby the encoraching ice 114 is prevented from adfreezing to the hull 36 or a bond between the frozen ice and the hull is broken, the flow of the heating fluid through the channels 116 and/or the temperature of such heating fluid can be increased whereby the bond between any ice which may have frozen to the hull is broken or the ice does not freeze to the hull.

In those hull compartments 40 positioned in the barge in the vicinity of region one of the hull, the flow of the fluid through the forced convection channels 116 preferably is such that a layer of ice is formed within each of the channels 116 on the interior surface of the hull sidewalls with only a small flow path remaining between the inlet and outlet of each channel. The ice formed within the channels 116 creates an insulating barrier within the barge which reduces heat loss from the barge in the area of the hull 36 denominated as region one. It is preferable that a flowpath through the channel 116 be maintained whereby if the ice needs to be melted within the channel, the magnitude of the flow of the fluid and the temperature of the fluid can be increased to cause such ice to melt. It can be observed that the heat sink chambers 118 illistrated in FIGS. 12, 13 and 14 provide a reservoir of heat for the fluid in the adjoining forced convection channels 116 and that the structure of the channels 116 is such that the heated fluid is forced to flow by the surface of the hull 36 and thereby more efficiently heat the surface of the hull 36.

Heat loss to the environment can be reduced by forming ice on that portion of the hull sidewalls 36 exposed to the surrounding air by actuation of the spraying system or by allowing an ice layer to form on the inner surface of the hull sidewalls 36. Sprayiing system pump 88 withdraws water from the surrounding sea through port 82 and ejects it out of nozzles 78 onto the hull sidewalls 36. Water sprayed onto the hull sidewalls 36 freezes and forms an insulating layer of ice. The insulating ice layer on the exterior surface of the sidewalls 36 will reduce the tendency of circulating fluid to freeze within the hull compartments 40.

Once the drilling operations have been completed, the drilling barge 20 may be moved to a new location so that drilling operations may be conducted at that new location. To move the drilling barge 20 to a new location, the hull 22 is deballasted and the hull bottom 90 is disengaged from the seabed floor. To assist the disengaging of the hull bottom 90 from the seabed floor, the pump means are activated to jet fluid out of the standpipes 98.

From the foregoing it can be seen that the drilling barge according to this invention provides a structure in which the lateral loads due to ice interaction with the barge is minimized and the accumulation of ice around the hull sidewall is prevented. Additionally, an insulating layer is provided around the hull sidewalls to prevent a heat loss to the surrounding air while still melting ice in the surrounding water. Additionally, the barge is designed to optimize holding contact between the hull bottom and the seabed floor while still enabling the hull bottom to be easily disengaged from the seabed floor. The foregoing description and disclosure of this invention is illustrative and explanatory thereof and various changes in the size, shape and materials, as well as in the details in the illustrated construction, may be made within the scope of the appended claim without departing from the spirit of the invention.

We claim:

1. An arctic drilling barge comprising:

a ballastible and deballastible hull including side walls and a bottom;

a deck on top of said hull;

the hull being shaped in the form of an upright frustrum in which the angle of inclination of the sidewalls of the hull with respect to the water line is between 25° and 45°;

a plurality of hull compartments within said hull adjacent the inside of the sidewalls, the hull compartments comprising a plurality of inclined, vertically oriented forced convection channels within the hull adjacent the inside of the sidewalls;

at least one interior compartment within the hull for receiving and storing fluid;

communicating means between each of the plurality of forced convection channels and the interior compartments for transporting fluid therebetween;

circulating pump means for pumping the fluid through the communicating means between the interior compartments and the plurality of forced convection channels;

heat source means for heating the circulating fluid prior to the time it is pumped into the plurality of forced convection channels; and valve means associated with the communicating means, the interior compartments and the plurality of forced convection channels whereby the heated circulating fluid can be circulated through various of the forced convection channels along the hull of the arctic drilling barge.

2. An arctic drilling barge according to claim 1 wherein each of the plurality of hull compartments includes a heat sink chamber in fluid communication with and associated with the forced convection channels of such hull compartment.

3. In an arctic drilling barge, a method of providing improved ice interaction capability, comprising the steps of:

providing for the barge a hull which is shaped in the form of an upright frustrum and in which the angle of inclination of the sidewalls of the hull with respect to the water line is between 25° and 45°;

providing a plurality of inclined, vertically oriented forced convection channels adjacent to the inside of the sidewalls of the hull;

providing at least one interior compartment within the hull for receiving and storing circulating fluid;

providing heat source means for heating the circulating fluid prior to the time it is pumped from the interior compartments into the plurality of forced convection channels;

circulating the fluid from the interior compartment to selected of the forced convection channels; and controlling the temperature and rate of flow of the fluid through the selected forced convection channels whereby a layer of ice is allowed to form in the channels associated with the portion of the sidewalls of the hull in contact with the air and substantially no ice is allowed to form in the selected forced convection channels associated with the portion of the sidewalls of the hull adjacent the encroaching ice.

* * * * *